US007299628B2

(12) United States Patent
Buller

(10) Patent No.: US 7,299,628 B2
(45) Date of Patent: Nov. 27, 2007

(54) PRESSURE WHEEL

(75) Inventor: Dennis Buller, 158 Burr Hill Rd., Killingworth, CT (US) 06419

(73) Assignee: Dennis Buller, Killingworth, CT (US)

( * ) Notice: Subject to any disclaimer, the term of this patent is extended or adjusted under 35 U.S.C. 154(b) by 0 days.

(21) Appl. No.: 11/330,165

(22) Filed: Jan. 12, 2006

(65) Prior Publication Data

US 2006/0174612 A1 Aug. 10, 2006

(51) Int. Cl.
*F07B 13/10* (2006.01)

(52) U.S. Cl. ..... 60/398; 290/54

(58) Field of Classification Search ..... 60/398; 91/4 A; 290/42, 43, 53, 54
See application file for complete search history.

(56) References Cited

U.S. PATENT DOCUMENTS

| | | | | |
|---|---|---|---|---|
| 896,581 | A * | 8/1908 | Robinson et al. | 417/94 |
| 932,446 | A * | 8/1909 | Combs | 417/334 |
| 1,035,993 | A * | 8/1912 | Moore | 417/94 |
| 4,001,597 | A * | 1/1977 | Graff | 60/398 |
| 4,820,134 | A * | 4/1989 | Karlsson | 417/336 |

* cited by examiner

*Primary Examiner*—Michael Leslie

(57) ABSTRACT

An waterwheel (6) using a spiral pump (1) which is attached to a scoop assembly (3) which runs the air and fluid to a separator tank (9), which then allows the air to an air turbine (15) and the fluid to a hydro turbine (16) will produce pressure which will turn the turbines listed which in turn will rotate an electrical generator producing electricity. This system changes the flow of the river in to rotation movement, which produces pressure, which produces mechanical rotational movement to turn a generator, which generates electricity.

1 Claim, 4 Drawing Sheets

POWER FLOW CHART

SCOOP ASSEMBLY, SPIRAL PUMP AND UNDERSHOT WATERWHEEL· ILLUSTRATION 1
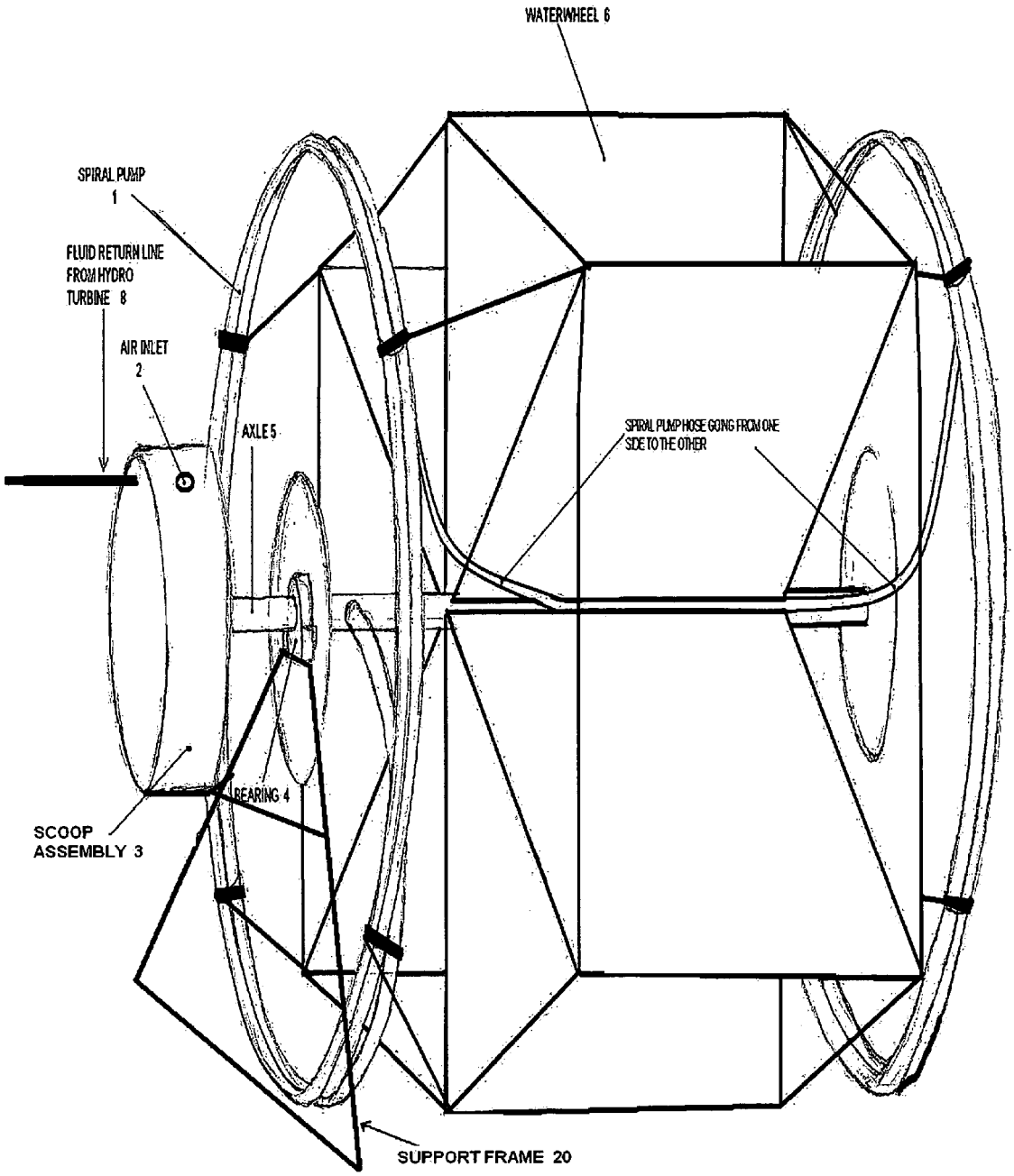

POWER FLOW CHART ILLUSTRATION 2
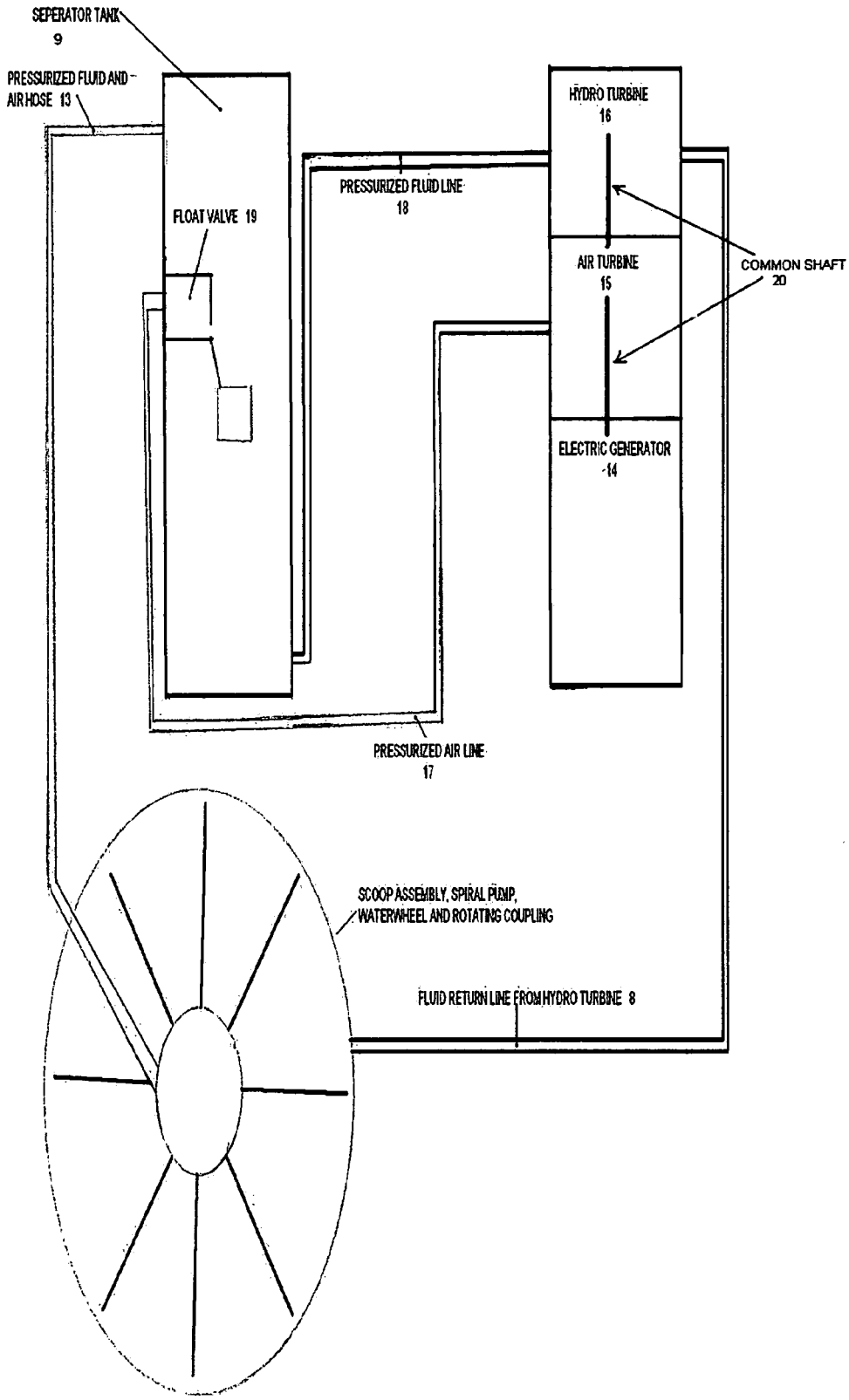

SCOOP ASSEMBLY SIDE OF PRESSURE WHEEL- ILLUSTRATION 3
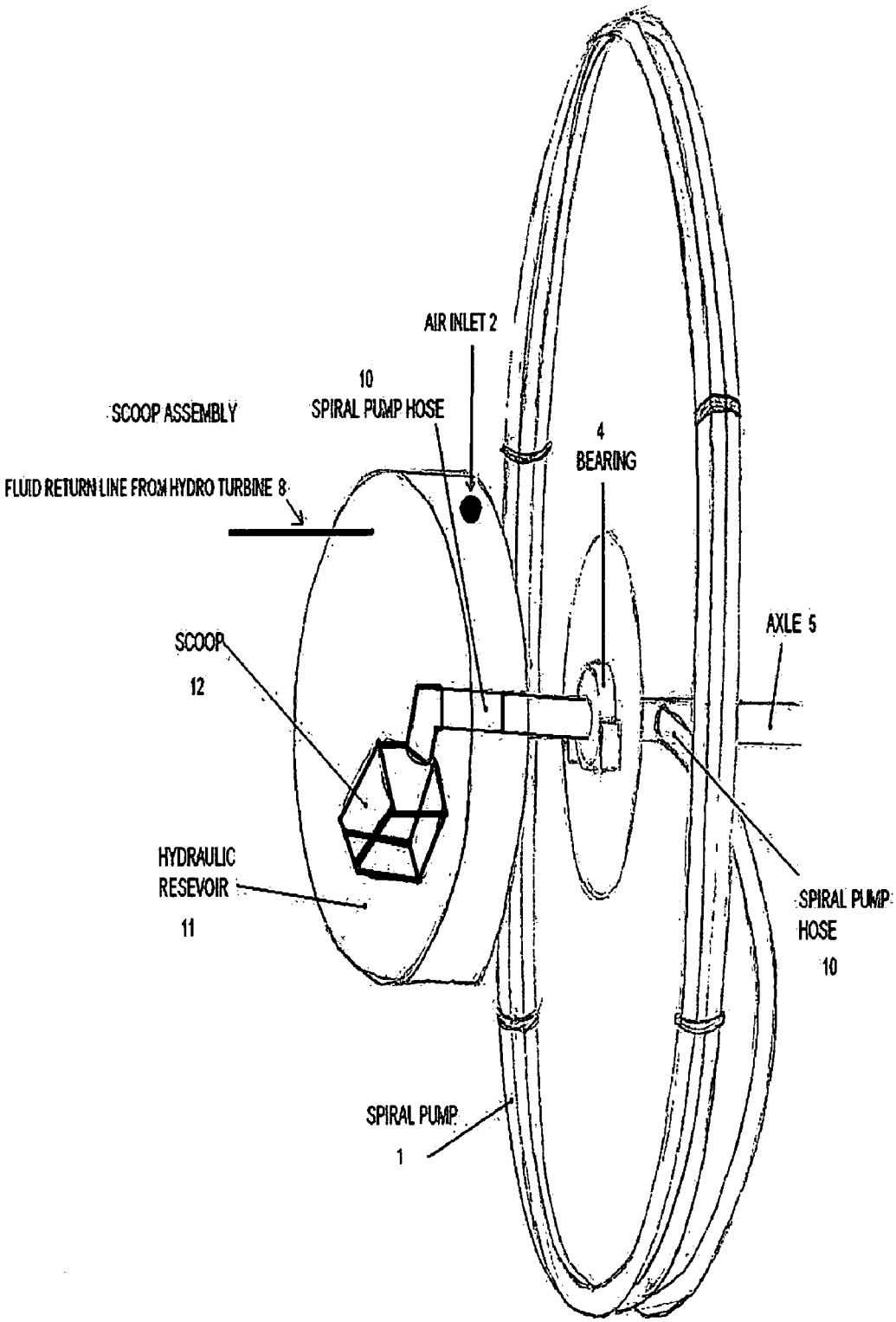

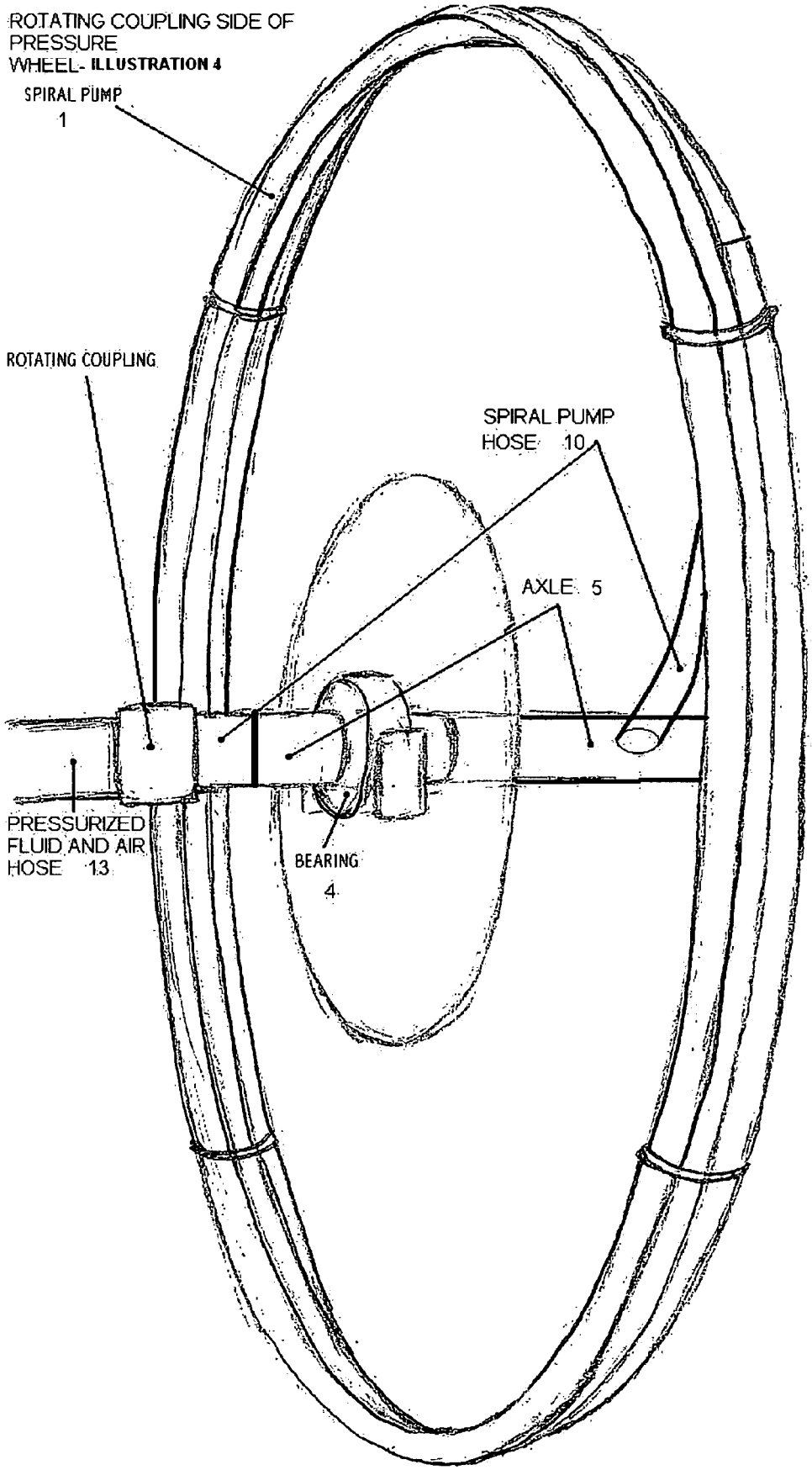
ROTATING COUPLING SIDE OF PRESSURE WHEEL- ILLUSTRATION 4
SPIRAL PUMP 1
ROTATING COUPLING
SPIRAL PUMP HOSE 10
AXLE 5
PRESSURIZED FLUID AND AIR HOSE 13
BEARING 4

PRESSURE WHEEL

CROSS REFERENCE TO RELATED APPLICATIONS

PPA 60/643,412.

FEDERALLY SPONSORED RESEARCH

None.

SEQUENCE LISTING

None.

BACKGROUND

Water power has always been the most successful non polluting power source. Large hydroelectric dams give 95% of the power needs of Canada, 11% of the United States. But large scale water power plants have fallen out of favor in the United States and are becoming harder and harder to build.

This is the latest design that I have created; it is simple and can generate power from the slow (but powerful) flow of a river or ocean.

Creating usable power from the slow movement of rivers and oceans has been tried many times, without economic success. I believe these failures are due to those designs being too complicated and having those complicated parts being immersed in water. Both of these issues raise the cost of building those designs to the point of being economically impractical.

My design makes power off of the flow of a river at very slow speeds, efficiently and with almost no moving/wearable parts.

U.S. Pat. No. 4,820,134, the "Loop Pump", is the closest to what I am proposing. It uses a Spiral pump to raise water. Since I am not proposing to use the pressurized air and liquid created by the spiral pump be used to raise water, but to spin prime movers to create electricity, my design is different in its application and includes extra systems to achieve this purpose.

SUMMERY

This is an adaptation of very old devises. The undershot waterwheel has been around for thousands of years (its earliest incarnation as the "Persian waterwheel" or "Noria") and the spiral pump was first described in Thomas Eubanks "Hydraulics and Mechanics" 1847 as the invention of a pewter in Zurich in 1746. These two devises have been used for quite some time to raise water for irrigation. I have taken these basic devises and added onto them to allow them to run turbines to create electricity.

The problem of creating electricity from a river has always been one of speed. Most common generators need at least 1000 RPM to generate significant amounts of power. Getting that type of revolutions per minute from a river that is moving between two and five miles an hour is problematic. In the past people have attempted to solve the problem by either using a large generator or a gearing system. Both of these solutions are expensive.

The undershot wheel and the spiral pump circumvent the problem by changing the mechanical motion of the wheel into hydraulic and pneumatic pressure.

The more pressure that is built in the system, the slower the wheel will turn. The slower the wheel turns the greater the impact of the river onto the paddles of the wheel, the greater the power that is generated.

DRAWINGS

Illustration one is an angular view of the spiral pump assembly (not broken down) the spiral pump and the waterwheel to show how they connect to one another.

Illustration two is a power flow chart that shows in detail how the separator tank, hydro turbine, air turbine and generator are connected together.

Illustration three is an angular view, which shows the scoop assembly in detail and shows how it connects to the spiral pump.

Illustration four is an angular view, which shows the rotating coupling side of the Pressure wheel. It breaks down into detail how the rotating coupling and spiral pump connect.

DETAILED DESCRIPTION

Illustration one shows the basic configuration of the scoop assembly (3), the spiral pump (1) and the undershot waterwheel (6). Everything rests on a support frame (20). The support frame is only shown on one side for simplicity sake. The spiral pump (1) is located on both sides of the waterwheel (6) for stability Illustration two is a power flow chart. Its main purpose is to show how the separator tank (9), hydro turbine (16), the air turbine (15) and the electric generator are hooked to one another. The scoop assembly (3), spiral pump (1), waterwheel (6) and rotating coupling are shown in the abstract with just a side showing of a wheel.

Illustration three shows the scoop assembly (3) in detail. It shows the scoop (12) connected to the beginning of the spiral pump (1) which is labeled spiral pump hose (10). This is done to show the hose going through the axle (5) and the bearing (4). The illustration also shows the fluid return line (8) and the air inlet hole (2). From this we can infer the beginning and the end of the complete system. The support frame is not shown for simplicity sake.

Illustration 4 shows the rotating coupling (7) side of the Pressure wheel. The main point of this illustration is to make it clear how the spiral pump (1) connects to the rotating coupling (7), which in turn connects to the pressurized fluid and air hose (13). This connection is accomplished by the spiral pump (1) going through the axle (5) and the bearing (4) (this section of the spiral pump (1) is shown as spiral pump hose (10) to clarify this point) connecting to the Rotating coupling (7) and then to the pressurized fluid and air hose.

REFERANCE NUMERALS

1. Spiral pump
2. Air Inlet
3. Scoop assembly
4. Bearings
5. Axle
6. Waterwheel
7. Rotating coupling
8. Fluid return line
9. Separator tank
10. Spiral pump hose
11. Hydraulic reservoir
12. Scoop
13. Pressurized fluid and air hose

14. Electric generator
15. Air turbine
16. Hydro turbine
17. Pressurized air line
18. Pressurized fluid line
19. Float valve
20. Support frame Operation:

The undershot water wheel is partially immersed in the flowing water (6). The Water wheels blades (6) are impacted upon by the flowing water, causing the wheel to turn on its two bearings (4). As the wheel turns the scoop (12) in the scoop assembly (3), and picks up fluid and air puts it into the spiral pump (1) by way of the spiral pump tube running through the bearing (4) and axle (5). The spirals are half full of liquid, and the air and fluid are moved along by the rotation of the wheel filling all of the spirals of one side of the spiral pump (1) and then going to the other side to finish filling the spiral pump completely with fluid and air through a spiral pump hose going from one side to the other (25). The liquid and air then exit the other side of the spiral pump (1) through the axle (5) and other bearing (4). At this point there is a spiral coupling (7) outside of the wheel, allowing the air and water to leave the spinning wheel and spiral pump and enter into the pressurized fluid and air hose (13), which is not spinning.

The liquid and air then enter a separator tank (25). The purpose of this tank is to send fluid to the hydro turbine and air to the air turbine. To achieve this, a float valve (19) is used. It regulates the level of the water in the separator tank by releasing air when the water level gets to a certain level.

From the separator tank (25), liquid goes to a hydro turbine (16) and the air goes to an air turbine (15). The fluid then acts on the hydro turbine (16) and the air on the air turbine (15) and causes them to spin, turning the common shaft (20), which turns the generator (14) and creates electricity.

Once through the hydro turbine (16), the fluid is then gravity fed back to the scoop reservoir, so the process may start over. The air that goes through the air turbine (15) is released to the atmosphere.

Operation:

A variation of this concept is to take a submersed turbine with a spiral pump attached to accomplish the same task as an undershot waterwheel. The scoop assembly, separator tank assembly, hydro turbine, air turbine and generator would still be required for this configuration to make electricity.

Another variation of this concept is to use an overshot waterwheel or breast waterwheel instead of an undershot wheel. The scoop assembly, separator tank assembly, hydro turbine, air turbine and generator would still be required for this configuration to make electricity.

The invention claimed is:

1. A River Powered Electrical Generating System Comprising

An undershot waterwheel having a reservoir and scoop assembly for holding and capturing liquid and air, a spiral pump attached to said waterwheel for alternately receiving the liquid an air from the reservoir and scoop assembly and transferring the liquid and air into a rotating coupling which is connected to a hose which transfers the liquid and air to a separator tank, which is connected to a hydro turbine via a liquid pressure line and an air turbine via an air pressure line when the level is below a predetermined level, wherein the hydro turbine and air turbine are connected together by a common shaft and the pressurized liquid and air drive the respective hydro turbine and air turbine to change the pressure into rotational movement that turns a generator connected to said common shaft for producing electricity.

* * * * *